US006578959B1

(12) United States Patent
Seccombe

(10) Patent No.: US 6,578,959 B1
(45) Date of Patent: Jun. 17, 2003

(54) PRINTER INCLUDING MICROWAVE DRYER

(75) Inventor: S Dana Seccombe, Foster City, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 206 days.

(21) Appl. No.: 09/608,597

(22) Filed: Jun. 30, 2000

(51) Int. Cl.[7] ..... B41J 2/01
(52) U.S. Cl. ..... 347/102
(58) Field of Search ..... 347/102, 101; 101/488; 343/101, 102; 219/692, 693

(56) References Cited

U.S. PATENT DOCUMENTS 5,220,346 A 6/1993 Carreira et al.
5,371,531 A 12/1994 Rezanka et al.
5,536,921 A * 7/1996 Hedrick et al. ..... 219/693
5,563,644 A 10/1996 Isganitis et al.
5,631,685 A * 5/1997 Gooray et al. ..... 347/102
5,837,184 A 11/1998 Firgo et al.
6,022,104 A 2/2000 Lin et al.
6,048,059 A 4/2000 Wafler
6,121,174 A * 9/2000 Yokoi et al. ..... 501/8
6,132,038 A * 10/2000 Szlucha ..... 347/102

* cited by examiner

*Primary Examiner*—Hai Pham
*Assistant Examiner*—Ly T Tran

(57) ABSTRACT

This invention relates to the art of printing, that is, using inks to print onto paper or other media. This invention relates to a dryer for removing water from printed sheets of paper or other print media. The dryer may emit evanescent microwave radiation which attenuates quickly in air. The frequency of the microwaves may be about 2.45 GHZ or any other frequency at which the electromagnetic field excites the dipole moments in water molecules. This results in friction which causes the water to evaporate. In one embodiment the invention is a printer having the dryer as a feature of the printer. In another embodiment, the invention is a dryer for a printer. The microwave radiation emitting dryer has a modest cost. It is suitable for use with low throughput printers as well as high throughput printers. The dryer does not cause discoloration of the print media.

11 Claims, 2 Drawing Sheets

PRINTER INCLUDING MICROWAVE DRYER

BACKGROUND OF THE INVENTION

The present invention relates generally to inkjet printers. More specifically, the present invention relates to a method and apparatus for removing water from printed sheets.

An inkjet printer includes one or more printer cartridges for depositing swaths of ink dots on a print medium. The ink dots are deposited in a controlled manner to produce text and images.

A thermal inkjet printer cartridge includes a housing and a printhead. The housing holds a reservoir of ink, which may be water-based. The printhead draws small quantities of ink from the reservoir, rapidly heats the small quantities of ink beyond boiling, and ejects the small quantities of ink through nozzles. The ejected ink is deposited on the print medium. Water in the ink is absorbed by a print medium such as paper.

High-throughput printers usually include dryers for removing water from the print medium. A typical dryer includes a glass bulb that generates infrared radiation, which heats the water and causes the water to evaporate.

However, the bulbs are expensive. Moreover, the infrared radiation heats the print medium and the ink, as well as the water. Discoloration (e.g., "browning") of the print medium can occur.

Low-throughput printers usually do not include dryers. The dryers are too expensive. Instead, the print medium is allowed to dry after being ejected from the printer. If the print medium is handled before it has dried, the ink can be smeared.

Moreover, if the water is not removed within ten to twenty seconds after the ink has been deposited, the water can cause the print medium to "cockle." Cockling occurs when the water is absorbed into cellulose fibers of the print medium. The water causes the fibers to swell and generate localized expansions. The localized expansions cause the print medium to warp and wrinkle. Warping and wrinkling can reduce print quality and overall appearance of the print medium.

There is a need for an inexpensive dryer for inkjet printers. There is also a need for a dryer that does not cause discoloration of the print medium.

SUMMARY OF THE INVENTION

These needs are met by the present invention. According to one aspect of the present invention, a printer includes a print medium path and a microwave dryer located along the print medium path. According to another aspect of the present invention, water may be removed by applying evanescent microwaves to a print medium.

Other aspects and advantages of the present invention will become apparent from the following detailed description, taken in conjunction with the accompanying drawings, illustrating by way of example the principles of the present invention.

DETAILED DESCRIPTION OF THE PREFERRED EMBODIMENT

Figure 1:
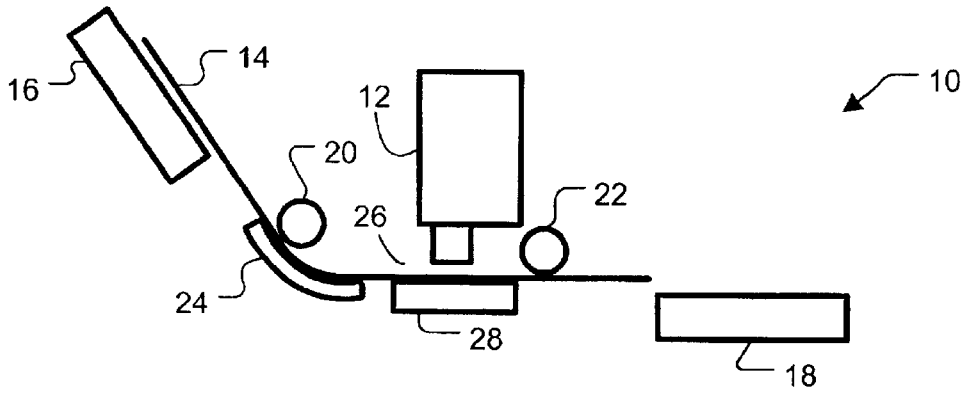
FIG. 1 is an illustration of an inkjet printer according to the present invention.

As shown in the drawings for purposes of illustration, the present invention is embodied in an inkjet printer having a microwave dryer for removing water from paper sheets. The microwave dryer can remove the water from the paper, without overheating the paper and the ink. Moreover, the microwave dryer is inexpensive to manufacture and simple to implement.

Reference is made to FIG. 1, which shows a printer 10 according to the present invention. The printer 10 includes a printer cartridge 12 and a paper path 14. The paper path 14 begins at a paper tray 16 and terminates at an output tray 18. A feed roller 20 and a drive wheel 22 advance sheets along the paper path 14. A curved shim 24 guides the sheet from the paper tray 16 to a print zone, which is beneath the cartridge 12. The print zone is referenced generally by numeral 26.

As the sheet is being advanced along the paper path 14, the cartridge 12 is repeatedly scanned across the sheet. Each time the cartridge 12 is scanned, it deposits a swath of ink dots on that sheet portion within the print zone 26. After the printing is finished, the sheet is deposited in the output tray 18.

The printer 10 further includes a microwave dryer 28 located along the paper path 14, between the print zone 26 and the output tray 18. The microwave dryer 28 generates microwaves that remove water from the paper without overheating the paper or the ink on the paper.

Preferably, the microwave dryer 28 is located at the print zone 26. There the water is removed right after printing, before the sheet has a chance to cockle.

Frequency of the microwaves may be about 2.45 GHz or any other frequency at which the electromagnetic field excites dipole moments in water molecules. Resulting is friction, which causes the water to evaporate. The wavelength of 2.45 GHz is typically used for microwave cooking.

A waveguide may be used to direct the microwaves onto the paper and prevent the microwaves from irradiating other components of the printer 10. Shielding may also be provided to prevent the microwaves from escaping the printer 10.

However, the waveguide and shielding are not needed if the microwaves are evanescent. Evanescent microwaves attenuate quickly in air. For the purpose of removing water from the paper, the evanescent microwaves need only propagate as far as the printed surface of the printed sheet.

The microwave dryer 28 may be designed in any number of ways. Devices for generating evanescent microwaves are known in the field of radar and microwave communications.

Figure 2:
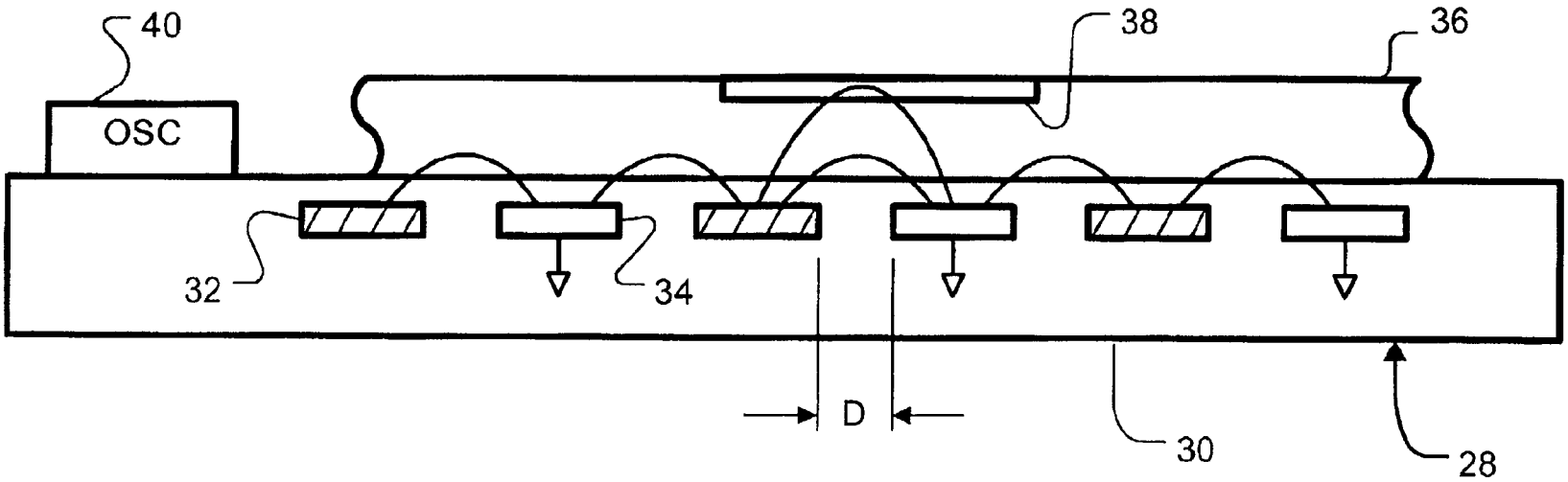
FIG. 2 is an illustration of a microwave dryer for the inkjet printer.

FIG. 2 shows an example of a microwave dryer 28. The microwave dryer 28 includes a thin printed circuit board 30 having first and second surfaces. A plurality of interdigitated metal electrodes 32, 34 are at the first surface of the printed circuit board 30. The printed circuit board 30 provides electrical insulation between the electrodes 32, 34. For instance, the electrodes 32, 34 may be partly or fully embedded in a dielectric material.

The odd-numbered electrodes 32 (cross-hatched) may be adapted to receive a microwave excitation signal, and the even-numbered electrodes 34 (not cross-hatched) may be grounded. When the microwave excitation signal is supplied to the odd electrodes 32, a fringe electric field is created in the vicinity of the sheet 36. The fringe field extends to the printed surface of the sheet 36 but not too far beyond.

The fringe field excites the dipole moments of only the water molecules in the sheet 36, thereby causing the water to evaporate. The fringe field does not affect the paper molecules, nor does it affect the molecules of the ink 38.

The electrodes 32 and 34 are spaced apart by no more than the length of the wavelength of the desired microwaves. The spacing D may be between 1/10 and 1/1000 of the desired wavelength. Microwave radiation wavelengths range between 1 millimeter and 1 meter. The microwaves used in microwave cooking have a wavelength of 12.2 centimeters.

However, the distance that the fringe field extends can be determined by the spacing of the electrodes 32 and 34. The electrodes 32 and 34 are preferably spaced apart by at least the thickness of the paper sheet in order to allow the fringe field to extend to the ink on the paper. Paper sheets typically have a thickness between one and five mils.

There are various ways in which the microwave excitation signal may be generated and controlled. For example, the microwave dryer 28 may include a free-running oscillator 40 that generates a microwave signal at a constant amplitude. As the water absorbs the microwave radiation, the signal amplitude is reduced. However, the oscillator 40 supplies additional power to increase the signal amplitude and maintain it at the constant level. Thus, power supplied by the oscillator 40 is proportional to the amount of water being absorbed.

Figure 3:
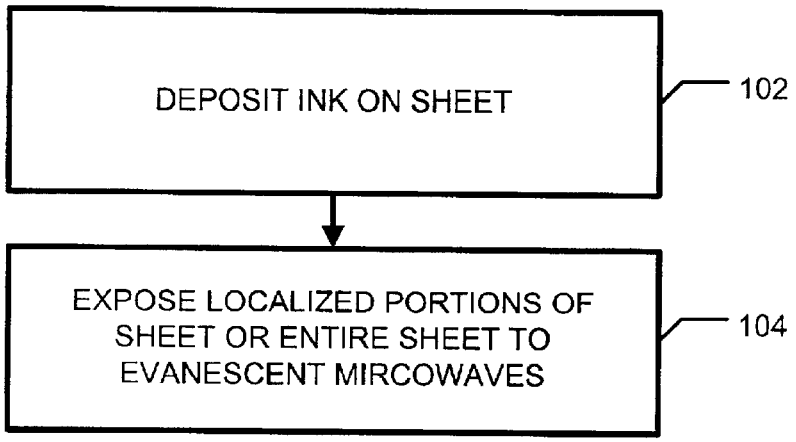
FIG. 3 is a flowchart of a method of printing a sheet of paper.

FIG. 3 shows a general method of printing a sheet of paper. Ink is printed on a sheet (step 102), and the printed portions are exposed to evanescent microwaves (step 104). The evanescent microwaves create a fringe electric field that causes water in the paper to be removed. The entire sheet may be exposed to the evanescent microwaves. In the alternative localized portions of the sheet may be exposed by applying the microwave excitation signal to selected electrodes (i.e., by addressing the electrodes).

Thus disclosed is a printer including a microwave dryer that can remove water from paper, without overheating the paper or the ink on the paper. If the printer includes a dryer that emits evanescent microwaves, a waveguide and shielding are not needed to prevent the microwaves from irradiating other printer components and escaping outside the printer.

Control of the microwave radiation is relatively simple. Because the microwaves do not overheat the paper, complex algorithms are not needed to control the amplitude of the microwaves to prevent browning of the paper. Moreover, the microwave dryer may be turned on as soon a sheet is drawn into the printer.

The microwave dryer is inexpensive to manufacture. It may be used on high throughput and low throughput inkjet printers.

The microwave dryer is simple to implement. It does not interfere with the paper path. If the electrode spacing is only a few mils, the excitation signal may be matched by a resonator, thereby resulting in a simple drive switch design. If the spacing is relatively large, the microwaves may be generated by a resonator. The oscillator power supply voltage would be relatively low and would allow inexpensive semiconductor oscillators to be used instead of Klaystron tubes.

The printer is not limited to a free-running oscillator for generating the microwave excitation signal. For example, the printer may use its processor to supply and control the oscillator.

The microwave dryer is not limited to electrodes that are interdigitated or elongated. Other designs may be used to generate the fringe field. For example, the microwave dryer may be formed by a plurality of circularly-shaped electrodes in a grid pattern. Such a pattern is standard for microwave ovens. The microwave signal and a reference signal (e.g., ground) are applied to alternating electrodes. As another example, the microwave dryer may be formed by upper and lower metal plates that are parallel. A voltage is applied to the lower plate and the microwaves propagate through patterns in the upper plate.

The microwave dryer is not limited to the locations illustrated in FIG. 1. The microwave dryer may be located anywhere between the print zone and the output tray.

The microwave dryer is not limited to inkjet printers. It may be used in any application for removing water from print media.

The print medium is not limited to paper sheets. Other types of print media may be used.

Use of the evanescent waves is not limited to drying a print medium. For example, the evanescent waves may be used to dry a medium such as cloth.

The invention is not limited to the specific embodiments described above. Instead, the invention is construed according to the claims that follow.

What is claimed is:

1. A printer comprising:

a print medium path; and an evanescent microwave dryer located along the print medium path the microwave dryer including a printed circuit board and a plurality of electrodes on the printed circuit board, the electrodes spaced apart by about a print medium thickness.

2. The printer of claim 1, wherein the printer is an inkjet printer.

3. The printer of claim 1, wherein the dryer generates microwaves having a frequency of about 2.45 GHz.

4. The printer of claim 1, wherein the electrodes are addressable.

5. The printer of claim 1, further comprising a free-running oscillator for supplying a microwave excitation signal to the microwave dryer.

6. The printer of claim 1, wherein the printed circuit board also defines a portion of the print medium path.

7. The printer of claim 1, wherein the microwave dryer is located at a print zone of the printer.

8. A dryer for a printer, the dryer comprising:

an electrode structure spaced apart by about a print medium thickness; and a signal generator coupled to the electrode structure for causing microwave radiation to be emitted from the electrode structure.

9. The dryer of claim 8, wherein the electrode structure includes a insulator member and a plurality of electrodes on the member.

10. The dryer of claim 8, further comprising a free-running oscillator for supplying a microwave excitation signal to the electrode structure.

11. The dryer of claim 8, wherein the signal generator causes evanescent microwave radiation to be emitted from the electrode-structure.

* * * * *